United States Patent [19]

Adelman et al.

[11] 4,050,347

[45] Sept. 27, 1977

[54] METHOD FOR PRODUCING EXPLOSIVE TRAINS

[75] Inventors: Stanley M. Adelman, Randolph Township, Morris County; Donal G. Ellington, Wharton; Philip J. Quatrochi, Stanhope, all of N.J.

[73] Assignee: The United States of America as represented by the Secretary of the Army, Washington, D.C.

[21] Appl. No.: 703,992

[22] Filed: July 9, 1976

[51] Int. Cl.[2] ..... C06B 21/00

[52] U.S. Cl. ..... 86/20 R; 86/1 R; 149/14; 149/15; 149/16; 264/3 R

[58] Field of Search ..... 149/14, 15, 16; 264/3 R; 86/1 R, 20

[56] References Cited

U.S. PATENT DOCUMENTS

| | | | |
|---|---|---|---|
| 1,942,899 | 1/1934 | Parsons | 149/16 X |
| 2,360,698 | 10/1944 | Lyte | 149/16 X |
| 2,873,642 | 2/1959 | Weingrad et al. | 86/1 R |
| 2,968,985 | 1/1961 | Seavey | 86/1 R |
| 3,325,317 | 6/1967 | Voigt | 149/16 X |
| 3,554,820 | 1/1971 | Evans | 149/19.4 |

FOREIGN PATENT DOCUMENTS

| | | | |
|---|---|---|---|
| 28,376 of | 1904 | United Kingdom | 149/14 |

*Primary Examiner*—Edward A. Miller

*Attorney, Agent, or Firm*—Nathan Edelberg; A. Victor Erkkila; Harold H. Card, Jr.

[57] ABSTRACT

A method for mass producing and loading explosive charges in detonators, leads, relays, primers, etc., utilizing the explosive charges each in sheet form. Sheets corresponding to the various increments, each containing the finely divided high explosive and binder therefor, are superposed in the proper order preferably on a sheet of closing disc material, and the resulting structure of layered sheets is cored to produce the explosive train. The coring can be accomplished with a battery of cutters so that large numbers of explosive trains can be cut to size simultaneously. The explosive train cores thus obtained can be pushed out of the cutters into cups, which are then crimped and sealed.

4 Claims, 2 Drawing Figures

METHOD FOR PRODUCING EXPLOSIVE TRAINS

GOVERNMENTAL INTEREST

The invention described herein may be manufactured, used and licensed by or for the Government for Government for Governmental purposes without the payment to us of any royalties thereon.

BACKGROUND OF THE INVENTION

Conventional detonators, primers, leads, relays and the like consist of cylindrical metal cups into which explosives and other chemicals constituting an explosive train are placed. The explosive train employed in detonators typically contains an ignition explosive charge, a primary explosive charge and a base charge of secondary explosive. The ignition charge, employed as the first component in an explosive train, is extremely sensitive to heat and mechanical shock and is generally considered to include such ignition (initiator) explosives as lead azide, lead styphnate, tetracene, diazodinitrophenol and hexanitromannite. Primary charges are readily ignited by the output energy of the ignition charge, heat, flame and moderate amounts of mechanical shock. Primary charges are generally lead azide, fulminate of mercury, diazodinitrophenol, potassium dinitrobenzofuroxan (KDNBF), etc. The base charge of a detonator is usually a secondary high explosive, which is not readily initiated by heat or mechanical shock but rather by an explosive shock from a primary explosive. Materials such as PETN (pentaerythritol tetranitrate), tetryl (2,4,6-trinitrophenyl methylnitramine), RDX (cyclotrimethylenetrinitramine), HMX (cyclotetramethylenetetranitramine), TNT (2,4,6-trinitrotoluene) and mixtures of TNT with other materials such as RDX, ammonium nitrate, etc., are generally considered to be secondary high explosives.

Detonators, primers, leads and the like are loaded by pressing the loose powdered explosive charges into the cup, usually in increments. According to an alternate technique used for many years, the powdered explosives are compressed into cylindrical pellets and loaded into the metal cups usually with the consolidated loose powdered increments and reconsolidated by pressing to produce the completely loaded detonator.

The aforesaid techniques traditionally employed for producing and loading explosive trains into detonators and the like have many disadvantages. Thus, they involve the hazards usually associated with the handling and processing of powdered explosives. In addition, the incremental loadings and several pressings of the powdered explosives are time consuming and require costly equipment. Further, the production and loading of preformed pellets by pelleting and reconsolidation techniques with loose increments is time consuming and requires the use of auxiliary equipment and operations. These methods also present problems in maintaining uniform product quality and are on the whole relatively inefficient.

SUMMARY OF THE INVENTION

A principal object of this invention is to provide a method for mass producing and loading explosive trains into detonators, primers, leads and the like, which overcome the disadvantages described above and provide a significant advance in the art.

Accordingly, the present invention provides a novel method for mass producing and loading detonators, primers, leads and the like by the use of ignition, primary and where required one or more secondary charges in sheet form for the explosive trains. More specifically, in accordance with the method of this invention, sheets corresponding to the various explosive charges or increments, which contain the finely divided explosive and a binder therefor, are superposed in the proper order for the explosive train, preferably on a sheet of closing disc material, and the resulting layered structure is cored. The coring can be accomplished with a battery of cutters whereby large numbers of cores can be cut to size at the same time. The explosive train cores thus obtained can be pushed out of the cutters into cups which are then crimped and sealed.

DETAILED DESCRIPTION OF THE INVENTION

Figure 1:
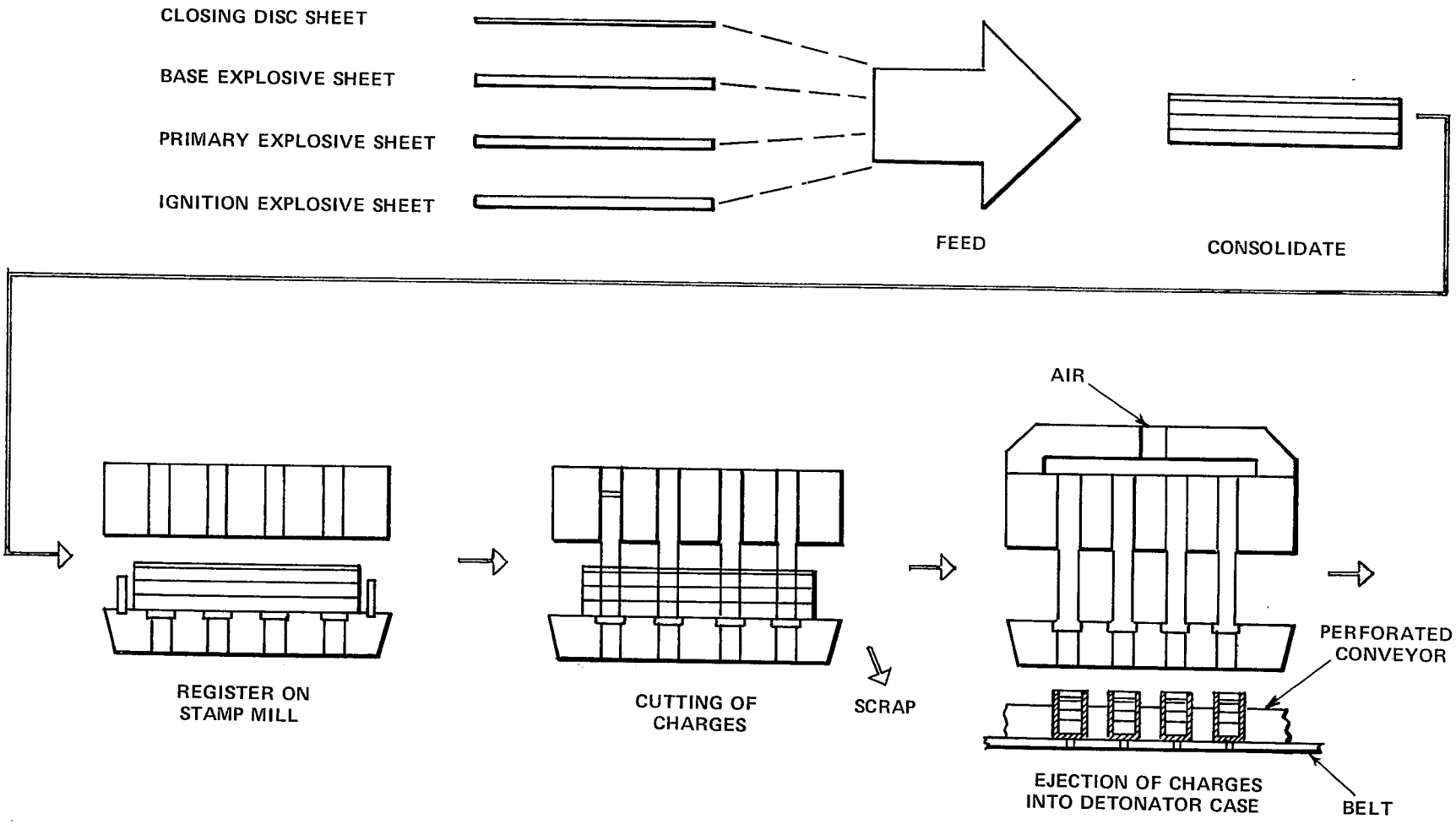
FIGS. 1 and 2 together illustrate a schematic flow diagram of the method for producing and loading detonators, etc., by the use of explosive charges in sheet form.
Figure 2:
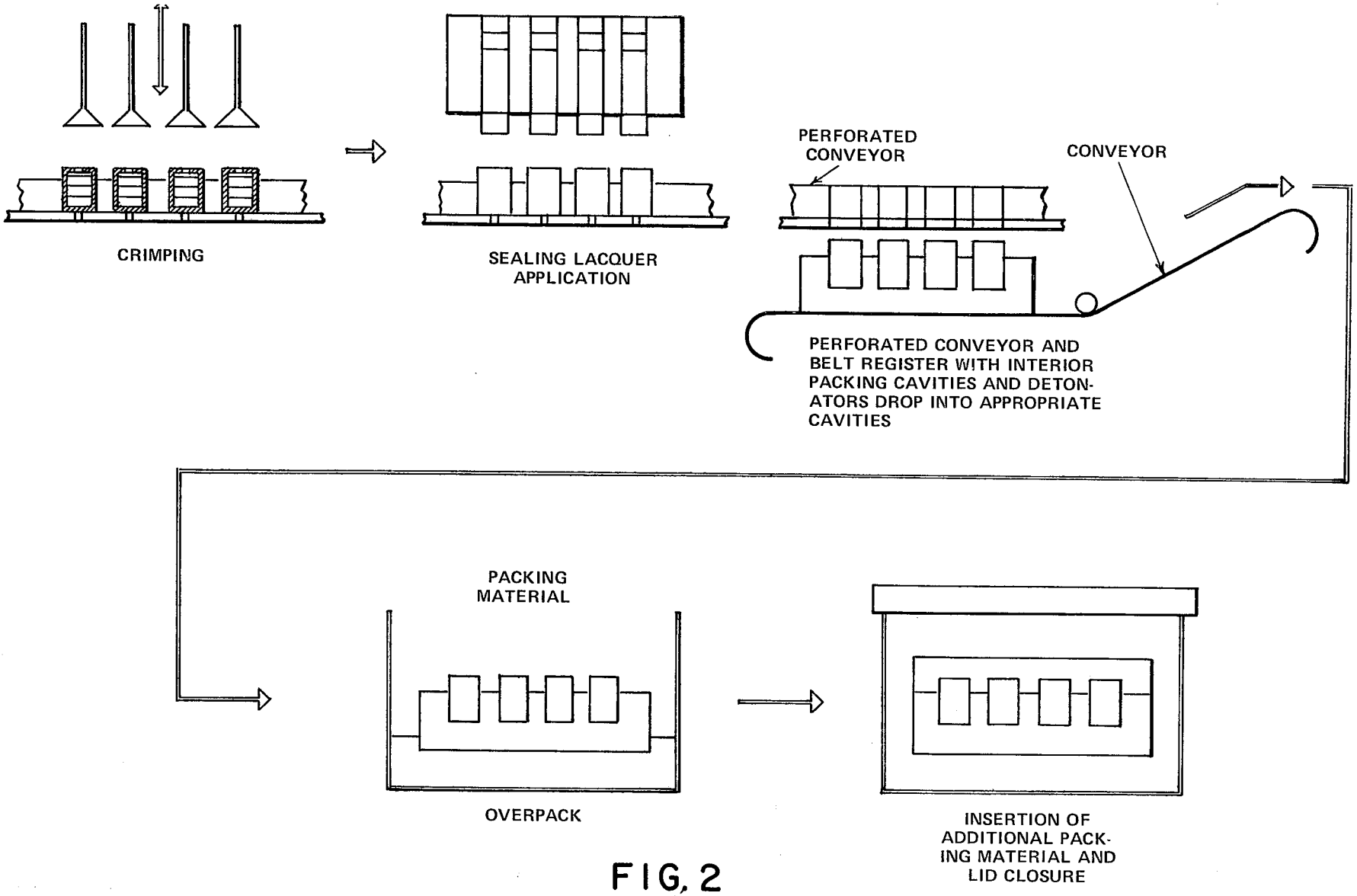

Sheet explosives suitable for use in the method of the present invention contain a mixture of finely divided particles of the ignition, primary or secondary high explosive and a binder therefor, such as an organic thermoplastic or thermosetting resin, and are in the form of self-supporting sheets. Such sheet explosives can be prepared by mixing particles of the high explosive in finely divided form and the resin binder in the presence of absence of plasticizers and/or volatile solvents until a homogeneous paste or putty-like mass is obtained, and then forming the mass into sheets by molding, rolling, casting, etc., during which the solvents are removed by evaporation and the resins are cured. Examples of suitable self-supporting sheet explosives containing an ignition, primary or a secondary high explosive are disclosed in U.S. Pat. Nos. 2999743, 3325317, 3400025 and 3554820.

By means of the present invention detonators and the like requiring an explosive train of several types of explosives can be quickly loaded and mass produced by indexing sheets of each explosive in proper relation to each other and backing the stacked sheets with a sheet composed of the material used for closing discs. The drawing shows a schematic flow diagram for processing explosives in sheet form to produce a typical detonator containing three explosive charges: an ignition explosive charge, a primary explosive charge and a base or secondary explosive charge. As shown in the drawing, the sheet explosives comprising the explosive train and the sheet of closing disc material in the proper geometric order are automatically fed, consolidated (stacked), indexed (registered) and positioned on the lower face or table of a stamp mill, which is provided with a battery of circular cutters mounted on the upper face of the mill. (Only four cutters are shown in the drawing, but the battery can contain a large number of cutters, e.g. up to a thousand or more). The cutters then slice through the stacked sheets, the edge of each cutter passing through the entire stack into a mating circular groove in the table to insure a complete cutting action. This groove is formed around the edge of a cylindrical anvil, which can be withdrawn. The cutters are axially recessed to permit the cored charges to slide inside the cutter body to the depth required to complete a clean cut. The anvils are then withdrawn and detonator cups, carried in perforations in a conveyor belt and supported therein by a second perforated belt positioned against the bottom of said conveyor belt, are placed in the spaces vacated by the anvils, after which the cored charges are forced out of the cutters into the detonator cups by a controlled air blast through the cutters. (Alternatively, the cored charges can be ejected from the cutters into the detonator cups by means of a mechanical punch issuing from the axis of the cutter). Scrap material can be reprocessed if feasible; otherwise it is destroyed.

The loaded detonator cups are then transported on the conveyor belt to the first station, wherein the open ended cup is crimped over the closing disc, and then to another station where a sealing lacquer is applied to the crimped end of the detonator by suitable means, the conveyor being indexed so that the detonators are in line with the crimping and sealing equipment. Finally, the crimped and sealed cups are carried on the perforated conveyor belt to a station, wherein the second perforated belt is shifted so as to align the perforations thereof with those in the conveyor belt so that the cups can drop or be forced out of the perforations into registering perforations in a tray container. The tray container is then conveyed to another station where it is provided with a lid and packed into a suitable container with packing material.

Stamping machines similar to those used in the paper, metal and plastics industries for cutting and coring sheet materials can be utilized for cutting the explosive train charges according to the present invention. The cutters in such machines are preferably passed through the stacked sheet explosive increments with a rotary motion to minimize hazards in the coring operation. Equipment for auxiliary operations, such as feeding, conveying, sealing, crimping and packing operations, similar to those presently in use can be employed. The equipment can be modified, as required, to accommodate the large scale, mass production operations contemplated by the method of the present invention.

By employing the explosive charges in the form of sheets of the thicknesses required for the explosive train, the present invention simplifies the transportation, feed and loading for the various explosive charges and renders the manufacture of the explosive train more compatible with the use of high rate equipment and automated production lines. In this manner it is possible to attain greater production rates, more uniform and reliable products, lower reject rates, lower down time ratio, economies in expense and in numbers of personnel required and greater safety in operations.

The foregoing disclosure and drawing are merely illustrative of the principles of this invention and are not to be interpreted in a limiting sense. We wish it to be understood that we do not desire to be limited to the exact details of construction shown and described, because obvious modifications will occur to a person skilled in the art.

We claim:

1. A method for producing at least one explosive train which comprises superposing a. a first layer of sheet explosive comprising finely divided particles of an ignition explosive and a binder therefor; and b. a second layer sheet explosive comprising finely divided particles of a primary explosive and a binder therefor;

coring the resulting structure of superposed sheets and ejecting said core of explosive train into a cup container.

2. The method of claim 1, wherein a third layer of sheet explosive, comprising finely divided particles of a secondary high explosive and a binder therefor, is superposed on said second layer.

3. The method of claim 1, wherein the structure of superposed sheets is cored simultaneously with a plurality of core cutters.

4. The method of claim 1, wherein a sheet of closing disc material is superposed on the last layer of sheet explosive in the explosive train, after which the resulting structure is cored, and the cored explosive train is ejected into a cup container so that the layer of ignition sheet explosive is adjacent to the closed end of the cup container and the closing disc material is adjacent to the open end of the cup container.

* * * * *